US008257124B2

(12) United States Patent
Garofalo et al.

(10) Patent No.: US 8,257,124 B2
(45) Date of Patent: Sep. 4, 2012

(54) SWIMMING FIN OF THE KIND PROVIDED WITH A FOOT POCKET OPEN AT THE HEEL ZONE

(75) Inventors: Giovanni Garofalo, Rapallo (IT); Aristide Barone, Rapallo (IT)

(73) Assignee: MARES S.p.A., Rapallo (IT)

( * ) Notice: Subject to any disclaimer, the term of this patent is extended or adjusted under 35 U.S.C. 154(b) by 146 days.

(21) Appl. No.: 12/502,392

(22) Filed: Jul. 14, 2009

(65) Prior Publication Data

US 2010/0015865 A1 Jan. 21, 2010

(30) Foreign Application Priority Data

Jul. 18, 2008 (IT) ..... GE2008A0061

(51) Int. Cl.
*A63B 31/08* (2006.01)

(52) U.S. Cl. ..... 441/64

(58) Field of Classification Search ..... None
See application file for complete search history.

(56) References Cited

U.S. PATENT DOCUMENTS

| | | | | |
|---|---|---|---|---|
| 1,185,411 | A | 5/1916 | Kennard | |
| 2,889,563 | A * | 6/1959 | Lamb et al. | 441/64 |
| 4,923,419 | A | 5/1990 | McCarthy | |
| 5,716,250 | A | 2/1998 | Garofalo | |
| 6,568,972 | B2 * | 5/2003 | Kawashima et al. | 441/64 |
| 6,568,975 | B1 * | 5/2003 | Perry et al. | 441/64 |
| 2004/0209534 | A1 * | 10/2004 | Graham | 441/64 |
| 2006/0068659 | A1 * | 3/2006 | Abbott | 441/64 |

OTHER PUBLICATIONS

European Search Report for European Application No. EP 09 16 5235.4, Oct. 14, 2009, European Property Office, Munich, Germany.

* cited by examiner

*Primary Examiner* — Lars A Olson
*Assistant Examiner* — Anthony Wiest
(74) *Attorney, Agent, or Firm* — Stites & Harbison PLLC; Marvin Petry

(57) ABSTRACT

Swimming fins of the kind comprising a foot pocket provided with a outsole and an upper closed at the tip and open at the heel zone, for lodging with slight clearance the feet of a scuba diver wearing diving booths, characterized by the fact that the outsole and/or the upper sections of the said fins are provided with a number of through holes.

2 Claims, 2 Drawing Sheets

SWIMMING FIN OF THE KIND PROVIDED WITH A FOOT POCKET OPEN AT THE HEEL ZONE

DESCRIPTION

The present invention has for its object swimming fins, and more particularly fins of the kind provided with a foot pocket open at the heel zone, and provided with a strap for securing it to the heel.

This kind of fin is particularly suited for scuba diving, and is practically indispensable whenever wearing boots provided with an outsole.

In order to allow one to wear the said fins easily over the heavy boots used for scuba diving, and to slip them off with the same ease, it is necessary that the foot pockets of the fins be not too adherent to the boots, but on the contrary that a certain side clearance be left between them and the boots.

One of the disadvantages of the known fins of this kind is mainly due to the fact that the above mentioned clearance which is present between foot pockets and boots causes during the swimming action, the so called "parachute effect", consisting in the fact that the water which is compressed between the boots and the walls and the sole of the foot pocket is expelled during each movement of the legs of the diver in a direction which is opposed to the forward direction, with consequent braking effect.

Another disadvantage of said fins which, as said before, are generally used whenever wearing boots with an outsole, resides in their weight which is not negligible, which causes fatigue to the muscles of the legs of the diver, with the possible formation of cramps.

From U.S. Pat. No. 2,889,563 a swim fin is known comprising a shoe pocket portion, comprising a sole and an upper including the toe and the heel, adapted to receive the foot of a swimmer. The said shoe portion is provided with a plurality of openings therethrough, helping to create a suction between the wearer's foot and the shoe portion, so as to aid in tightly gripping the foot.

This gripping action is exactly the contrary of the action which is needed in a fin for scuba divers wearing diving boots, in which the fin needs to be slipped on and off rapidly and in easy manner whenever, for instance, the diver wearing said fins has to climb again onto the boat after diving.

It is therefore the main object of the present invention to provide a swimming fin of the above mentioned kind in which the above mentioned disadvantages of the prior art fins are eliminated or at least greatly reduced.

According to a main feature of the present invention the above object is obtained by forming in the foot pocket of the fin, either in the sole or in the upper or on both said parts, a number of through holes having a diameter in the order of some millimeters, and for instance a the diameter from 2 to 6 millimeters.

Because of the presence of said holes, the following advantages are obtained:

1) a consistent lightening of the mass of the fin, which reduces minor fatigue for the legs of the diver.

2) the elimination of the so called "parachute effect", since the water which is compressed between the foot and the walls of the foot pocket is now expelled through said holes in a direction in concord with the forward direction, thus nullifying and eliminating any brake effect.

Further objects and advantages of the fin according to the present invention will be better evident in the course of the following description of a preferred embodiment of the invention made with reference to the annexed drawings, in which.

Figure 1:
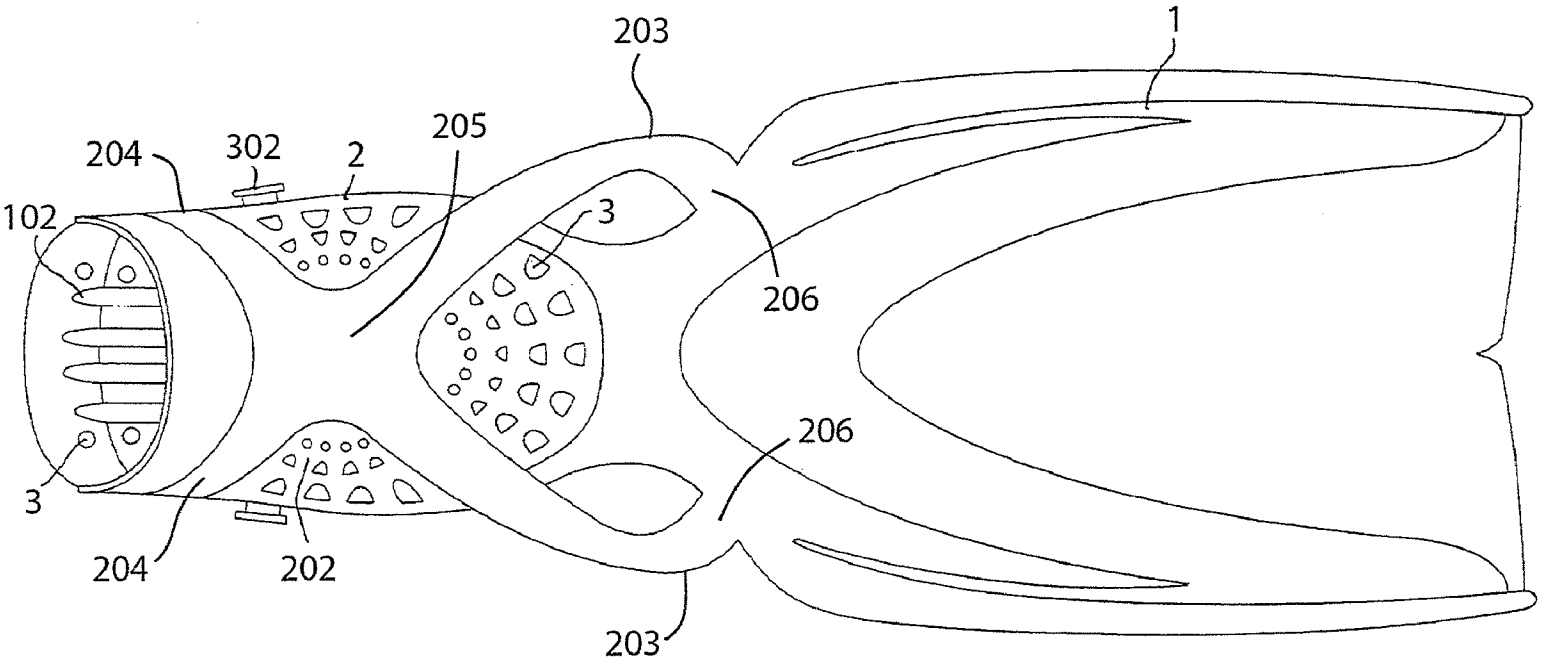
FIG. 1 is plan view from above of a fin according to the invention.
Figure 2:
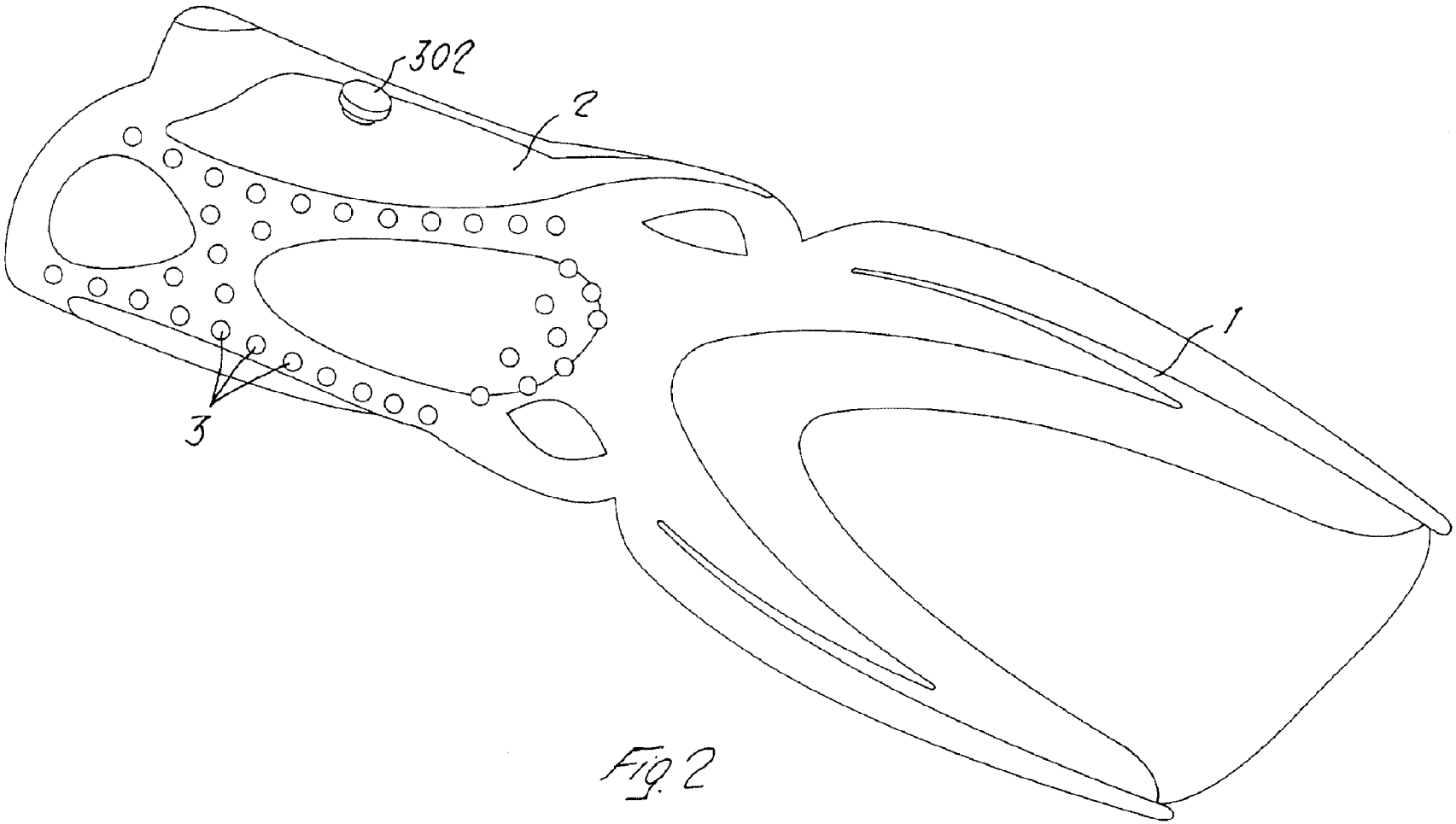
FIG. 2 is bottom plan view of the same fin.

With reference to the drawings, the fin shown comprises a blade 1 to which the "foot pocket" 2 is joined. In the fin shown, the foot pocket 2 is of the kind closed at the tip and open in the rear, which means that the heel portion is missing. This kind of fin is, as already stated, particularly suited for diving with SCUBA apparatuses, and is practically indispensable whenever wearing boots with outsoles.

The foot pocket 2 comprises a sole portion 102 and an upper portion 202. Sidewise from the upper 202 pins 302 are provided for securing the heel strap (not shown).

According to the main feature of the present invention both the outsole 102 and the upper 202 are perforated by means of a close net of holes 3. The said holes 3 have advantageously a diameter ranging from 2 to 6 millimeters, and preferably a diameter of 4 mm. The upper includes strip portion 203 which are free of holes 3 extending from 204 near the back opening, interesting each other a 205 and attached at their front ends 206 to the blade 1, forward of the foot pocket 2.

The advantages of the holes 3 are twofold; first because of the removal of material for their formation, they provide a substantial lightening of the mass of the fin, which involves less fatigue for the legs of the diver, and second, they assist the elimination of the so called "parachute effect" since the water which is compressed between the foot and the walls of the shoe is now expelled through said holes, thus nullifying and eliminating any brake effect.

Preferably, the sole portion 102 of the fin is made from an elastomeric material having a hardness and/or a thickness greater that the hardness and/or the thickness of the elastomeric material forming the upper portion 2. The total surface of the holes of the upper and/or of the sole correspond to about ⅙ to ⅓ of the total surface of said portions.

Although the fin according to the invention was shown as provided with holes 3 both on the sole portion 102 and on the upper portion 202 of the foot pocket, it is to be understood that the said holes may be formed on only one of the said mentioned parts, while retaining the above noted advantages.

The invention claimed is:

1. A swim fin comprising:

a foot pocket opened in the back and closed in the front, a blade attached to the front of the foot pocket said foot pocket comprising a sole and an upper, both the sole and the upper comprising a plurality of holes having a diameter between two and six millimeters, and wherein the total surface area of the holes is about ⅙ to ⅓ of the total surface area of the upper and sole, the upper including strip portions which are free of said holes extending from near the back opening and intersecting each other and attached at their front ends to the blade, forward of the foot pocket, whereby when a diver's foot with a boot is located in the foot pocket, water is expelled through said holes.

2. A swim fin according to claim 1, wherein the sole is made from a material having a hardness and/or a thickness greater than the hardness and/or thickness of the upper.

* * * * *